United States Patent [19]

Standaart, deceased et al.

[11] 4,071,932

[45] Feb. 7, 1978

[54] METHOD OF MAKING ELECTRON GUNS FOR CATHODE RAY TUBES AND THE LIKE

[76] Inventors: Adrian W. Standaart, deceased late of Winston-Salem, N.C.; by Josephine Benson Standaart, administratrix, 5 Bonbrook Circle, Winston-Salem, N.C. 27106

[21] Appl. No.: 736,717

[22] Filed: Oct. 28, 1976

[51] Int. Cl.[2] ..... H01J 9/02

[52] U.S. Cl. ..... 29/25.14; 29/25.16; 29/25.18

[58] Field of Search ..... 219/121 LM; 29/25.14, 29/25.18, 25.16; 408/701

[56] References Cited

U.S. PATENT DOCUMENTS

| | | | |
|---|---|---|---|
| 3,251,641 | 5/1966 | Gaylord | 29/25.14 |
| 3,562,009 | 2/1971 | Cranston et al. | 219/121 LM |

*Primary Examiner*—Richard B. Lazarus
*Attorney, Agent, or Firm*—Mason, Fenwick & Lawrence

[57] ABSTRACT

A method of processing elements of an electron gun assembly for electron beam tubes and the like, wherein the electron gun assembly in completed form includes a cathode and at least a control grid and first anode rigidly assembled together, the control grid and first anode each comprising a substrate having a substrate aperture therethrough and a flat face substantially perpendicular to the electron beam to be formed covered with a thin layer of metal at least adjacent the substrate aperture having a shaped beam-controlling aperture therethrough. The control grid and first anode substrates are processed to preform the substrate apertures therein, the flat metal layers are formed on a flat face of the substrates spanning the substrate apertures, these substrates and the cathode are mounted as a rigid skeleton subassembly on a laser bench, and a laser beam is directed onto portions of the metal layer spanning the substrate apertures to form the beam control apertures therein.

20 Claims, 7 Drawing Figures

Fig-1
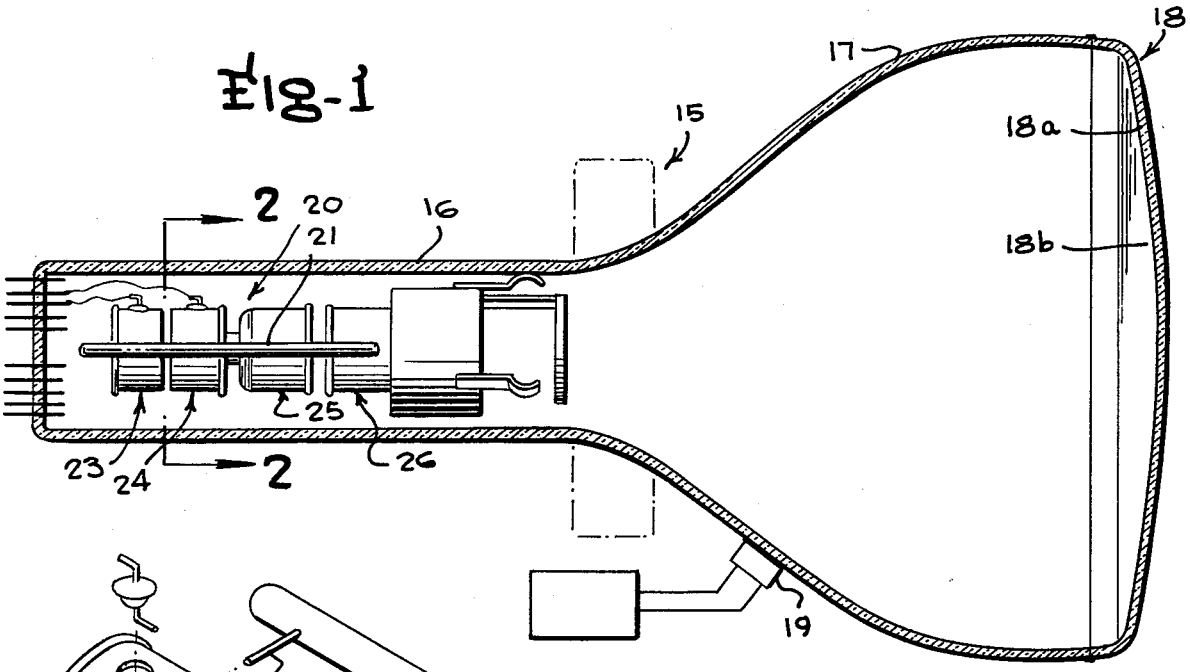
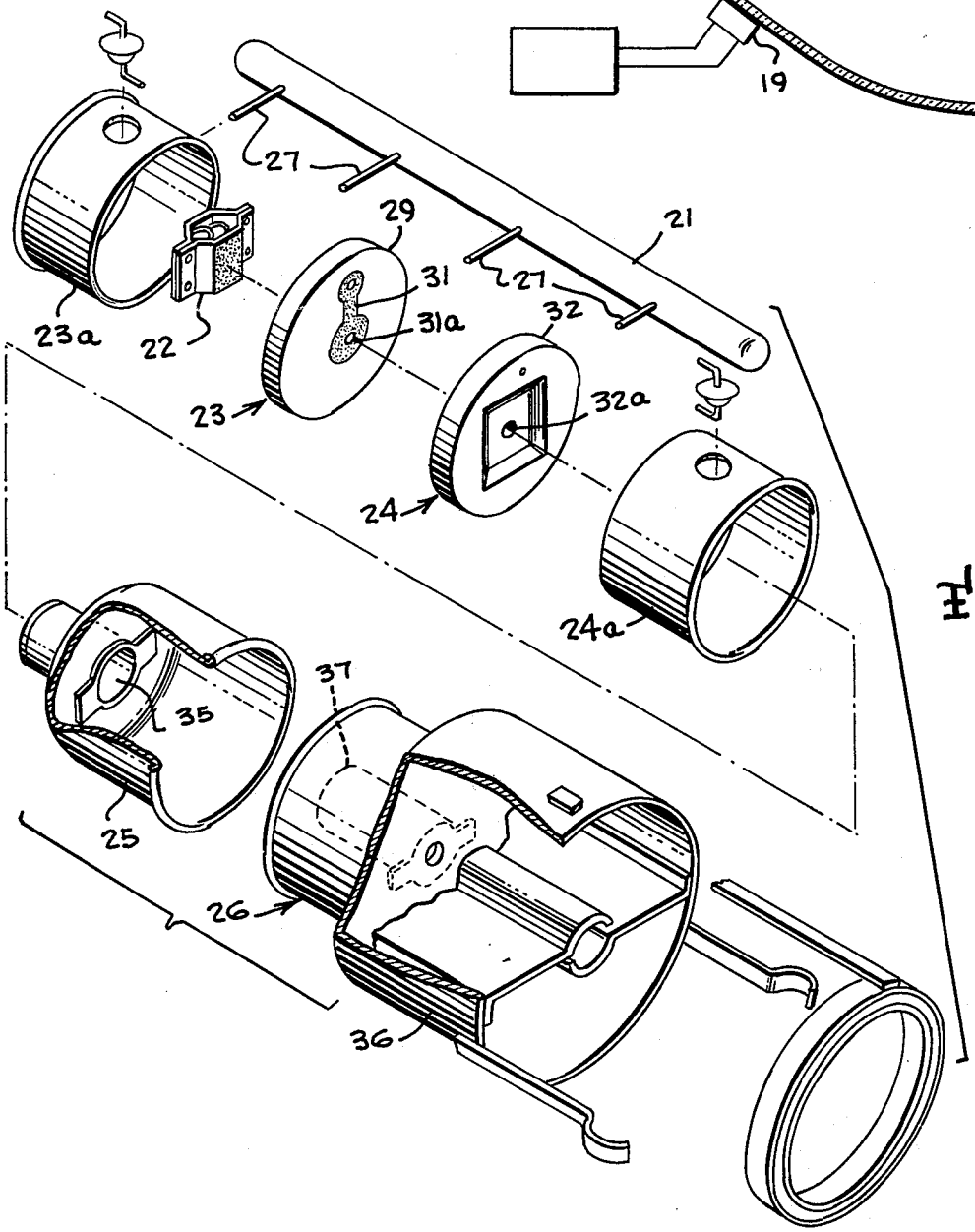
Fig-4

METHOD OF MAKING ELECTRON GUNS FOR CATHODE RAY TUBES AND THE LIKE

BACKGROUND AND OBJECTS OF THE INVENTION

The present invention relates in general to cathode ray tubes, and more particularly to methods of making an electron gun having a single cathode, a control grid, a first anode, a focusing anode, and an accelerating anode, for producing an electron beam to be scanned repetitively along a phosphor screen, such as color-producing phosphor screens, to produce image displays on the faceplate of a cathode ray tube.

Most frequently, cathode ray tubes of the type used to produce the color image for multi-color displays for television receivers, computer readout displays, and the like, particularly those commonly referred to as color picture tubes, have customarily been of the shadow mask type having openings precisely positioned for passage of electron beams therethrough onto color-producing phosphor dots on the faceplate, and have customarily employed an electron gun assembly forming a battery or array of three electron guns for producing three electron beams which approach the shadow mask along different angles of divergence to selectively direct them onto phosphor dots of selected colors. Each electron gun customarily includes its own cathode and heating filament, its own control grid, first anode, focusing anode and accelerating anode for controlling the electron beam produced by the electrons emitted by the associated cathode.

More recently, cathode ray tubes for color television image production or other multi-color readout display have been devised wherein a single electron gun is provided for producing a single electron beam or three electron beams which are scanned over the phosphor screen area of the faceplate of the cathode ray tube in selected fashion, without the use of a shadow mask, thereby eliminating the significant cost and complexity of shadow mask type cathode ray tube construction as well as reducing the cost of the electron gun assembly compared to three gun cathode ray tubes. Some of these prior single gun cathode ray tubes have involved scanning one or a plurality of electron beams along the longitudinal axis of substantially horizontal strips of color phosphor making up the phosphor screen, while others have involved the scanning of a single beam substantially horizontally across the screen area to intercept vertically elongated phosphor strips vertically spanning the screen area and arranged in selected sequence to be successively intercepted by the electron beam.

My earlier U.S. Pat. Nos. 3,194,641 and 3,771,002 disclose a cathode ray tube and electron gun structure wherein a single electron gun produces one or a plurality of beams to be scanned relative to strips of color phosphor material to intercept the phosphors in selected fashion and produce color images. The electron gun structure of those patents involves, in addition to the cathode, focusing anode and accelerating anode elements, the provision of a control grid and first anode, sometimes also referred to as G-1 and G-2 electrodes, fixed to the same supporting frame as the other elements and formed of a ceramic substrate or panel, there shown to be of oval profile, with each of the substrates having one or more precisely sized and located beam-forming apertures therethrough and one of the faces of each of the substrates being coated with a thin, precisely formed layer of metal which also lines the cylindrical surfaces of the apertures, and which has suitable connections to conductive leads to the biasing voltage source for the electron gun elements.

It will be appreciated that a very high degree of alignment accuracy and precision is required with respect to the supporting arrangement for the various elements of the electron gun and for the relative location of the beam-forming apertures in the control grid and first anode to achieve proper directivity configuration and size of the electron beam or beams. As higher resolution is required in cathode ray tubes, the size of the phosphor strips or other phosphor elements making up the image screen is made smaller, requiring better shaping and landing accuracy of the electron beam and thus giving rise to a lower tolerance of errors caused by poor alignment of the electron gun elements. Maintenance of proper beam-forming hole size and location in the metal layers on the subtrates for the control grid and first anode with the requisite accuracy becomes more and more difficult if they are to be formed by conventional hole-forming processes, especially as the requirement for beam sizes of smaller and smaller diameter becomes greater. Also poor alignment may arise at various stages of the assembly process for electron guns, as the electron gun elements are customarily mounted on support rods, commonly made of an electrical insulating material such as glass, with the various elements of the electron gun assembled to the elongated glass support rods by radially extending mounting wires embedded in the glass rods and fastened to the perimeters of the electron gun elements or to metallic shields surrounding and affixed to such elements. All of these factors give rise to considerable difficulty and expense in attempting to achieve satisfactory uniformity in mass production of such electron guns and have stimulated a desire for improved methods of manufacture of electron guns of this type.

An object of the present invention, therefore, is the provision of a novel method of manufacture of an electron gun for producing a single electron beam or plural electron beams for cathode ray tubes and the like, wherein apertures for the metallic conductive layer on the substrate of the control grid and first anode elements of the electron gun are precisely formed after assembly of these elements on the electron gun supporting framework by positioning such subassembly on a suitable bench assembly, preferably vibration-free, provided with means for producing a laser beam of appropriate diameter and means for directing the laser beam onto the metallic layers of the control grid and first anode elements to produce apertures of the precise desired size, shape and location, and thereafter assembling the remaining electron gun elements such as the filament and other electrodes on the supporting framework.

Another object of the present invention is the provision of a novel method of forming an electron gun for producing a single electron beam for cathode ray tubes and the like in which the electron gun includes a cathode, focusing and accelerating anodes, and a control grid and first anode comprising a pair of substrate elements each having a thin layer of metal on the surface thereof and a preformed aperture in the substrate material, wherein the substrate elements and associated metal layers are assembled on an electron gun supporting framework before positioning of the cathode element thereon and such subassembly is placed on a suitable bench assembly provided with a laser light beam source producing a laser beam diameter no larger than the minimum transverse dimension of the electron beam to be produced, and positioning such subassembly relative to the laser beam source so that the laser beam passes through the preformed apertures in the substrate elements and onto the metallic layers thereby forming the apertures of appropriate shape, size and position in the metallic layers of the substrate elements, and thereafter assembling the remaining elements to the supporting framework to complete the electron gun.

Another object of the present invention is the provision of a novel method of producing an electron gun as described in the immediately preceding paragraph, wherein electron beam-forming apertures of oval or elongated slot shape configuration are provided in the metallic layers on the substrates by subjecting the laser beam and/or the substrate elements to controlled relative transverse movement with respect to the laser beam axis to produce non-round transversely elongated apertures of appropriate size and shape in the metallic layers associated with the substrate.

It will be evident that the present invention may also be used in fabricating electron guns intended for use in devices other than cathode ray tubes. For example, television camera tubes such as the image orthicon and vidicon tubes employ electron guns, the production of which will also benefit by applying the novel method disclosed herein.

Other objects, advantages and capabilities of the present invention will become apparent from the following detailed description, taken in conjunction with the accompanying drawings illustrating a preferred embodiment of the invention.

BRIEF DESCRIPTION OF THE FIGURES

FIG. 1 is a vertical section view of a cathode ray tube having a single beam electron gun, shown in elevation, embodying the present invention;

FIG. 4 is an exploded perspective view of the electron gun, with parts broken away;

DETAILED DESCRIPTION OF A PREFERRED EMBODIMENT

Figure 2:
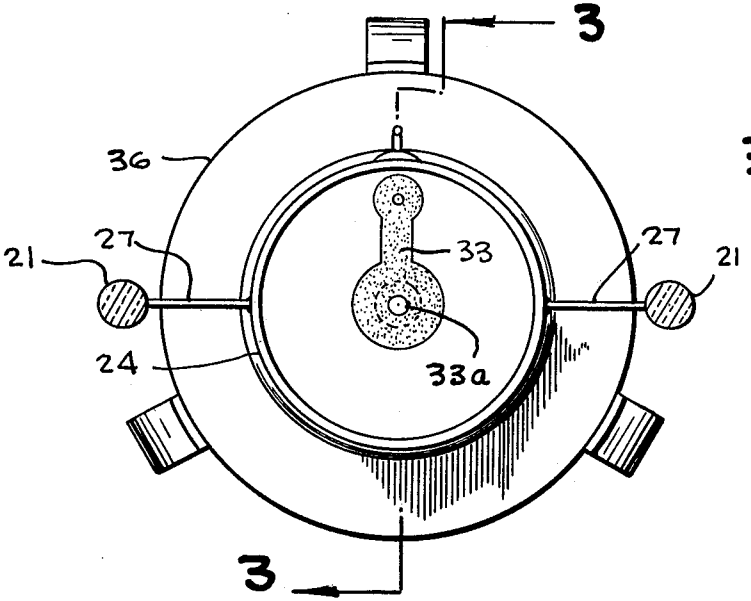
FIG. 2 is a vertical transverse section view, taken along the line 2—2 of FIG. 1.
Figure 3:
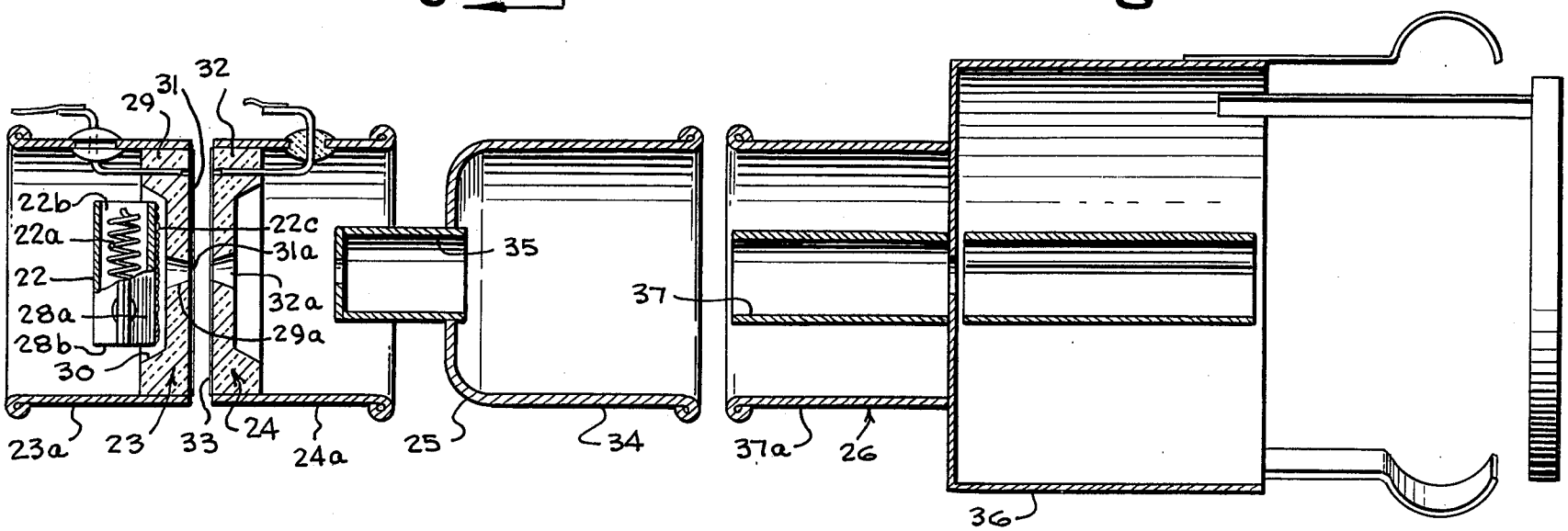
FIG. 3 is a fragmentary horizontal section view of the electron gun, taken along the line 3—3 of FIG. 2 and shown to enlarged scale.

The electron gun construction to be produced by the novel method of the present invention is designed to be incorporated in cathode ray tubes of various types, for example cathode ray tubes requiring only a single electron beam for activating the phosphor display screen or cathode ray tubes having three vertically spaced beams to be scanned over the phosphor screen area, or cathode ray tubes having many beams arranged in a matrix pattern to simultaneously form a character. The ensuing description will be directed to an electron gun construction for a cathode ray tube, for example as indicated generally by the reference character 15 in FIG. 1, which may be broadly described as a single electron gun, single beam, multi-color cathode ray picture tube for a color television receiver and the like requiring only a single electron beam and having phosphor strips, lines, or arrays of phosphor dots, as desired, arranged along either substantially horizontal scan lines or arranged vertically to be scanned by a horizontally scanning electron beam to produce light of any predetermined single color. It will be understood that the electron gun is equally applicable to black-and-white cathode ray tubes to produce white light. In the herein described example, the cathode ray tube 15 comprises a single glass envelope having an elongated body portion made up of the neck section 16 and funnel section 17, joined at the forward end of the funnel section 17 to a faceplate section 18 which is usually separately produced and joined to the funnel section after the light producing phosphor screen is formed on the front faceplate **18*a* of the faceplate section. In this described example, the color phosphor screen is formed of narrow, vertically elongated strips of deposited phosphor material spanning the vertical height of the image area of the faceplate 18*a* which is viewed by the observer of the television receiver in which the tube is mounted, with the strips being arranged in recurring or repeating sets or bands of phosphor strips. For example, recurring sets of three color-producing phosphor strips or color element strips, usually made up of a red color-producing phosphor, a green color-producing phosphor, and a blue color-producing phosphor, arranged in what in sometimes referred to as recurring "triads" may be provided. Alternatively, the cathode ray tube may be of the indexing type, in which event phosphor strips designed to produce index signals when struck by the scanning electron beam, for example, phosphors for producing ultraviolet light or light in a particular region of the electromagnetic spectrum, may be provided at predetermined spaced locations along the beam scanning path and be in the form of vertically elongated phosphor strips paralleling the red, green and blue color-producing phosphor strips, to be sensed by an ultraviolet sensor 19 receiving the UV radiation through a clear zone of the funnel 17** and connected to suitable beam indexing circuitry.

A single electron beam, produced by the single electron gun, indicated generally by the reference character 20, is directed from a location adjacent the rear or neck portion 16 of the cathode ray tube to the faceplate **18*a* to strike the phosphor strips forming the phosphor screen 18*b*, and the beam is scanned transversely, in the described example, across the image area of the screen 18*b* in scanning strokes which parallel each other and progress downwardly over the screen area in a manner similar to the development of the usual raster or scanning pattern on a conventional television picture tube. The array of color phosphor strips making up the image or screen area of the tube may be provided with a metallic backing layer, such as the usual aluminum backing layer which is rearwardly applied to the phosphor strips and is subjected to the same biasing voltage as the customary interior graphite coating which covers the inner surface of the funnel portion of the tube, or the metallic backing layer for the phosphor screen may be eliminated and conductive strips of electrically conductive material may be interposed between certain of the phosphor strips and may be subjected to appropriate biasing potentials as described in my copending patent application Ser. No. 696,277 filed June 15, 1976 entitled BEAM INDEXING COLOR CATHODE RAY PICTURE TUBES AND THE LIKE. Either a conventional deflection yoke and/or a special deflection yoke, indicated by broken lines in FIG. 1**, may be provided surrounding the transition area between the neck and funnel portions of the tube to effect magnetic deflection of the electron beam in accordance with standard practice. Alternatively, the electron beam may be electrostatically deflected by electrostatic deflection plates provided within the glass envelope or combinations of electrostatic and yoke deflection may be used.

The electron gun 20 of this illustrated embodiment is preferably of a construction generally resembling the electron gun disclosed in my earlier U.S. Pat. Nos. 3,914,641 or 3,771,002, but constructed with only one aperture in each of the control grid and first anode elements, or electrodes G-1 and G-2, to form only one beam instead of three beams. The electron gun 20 as finally assembled into a unitary electron gun unit includes a supporting framework, generally indicated by longitudinally extending frame members formed of elongated glass rods or the like, indicated generally at 21, which directly or indirectly support the basic electron gun elements comprising the cathode 22, the control grid 23, the first anode 24, the focus anode 25, and the accelerating anode assembly 26 resembling such elements of said earlier U.S. patents. The control grid, first anode, focus anode and accelerating anode may, for example, be spot welded to end portions of supporting wires or strips 27 during assembly of the electron gun, with the cathode 22 mounted adjacent to the control grid 23, so that the entire electron gun assembly, when completed, can be inserted as a unit in the neck section 16 of the cathode ray tube.

In the ultimate or final electron gun unit, as finally assembled ready for installation in the neck portion of the cathode ray tube, the cathode element 22 in the illustrated embodiment is a honeycomb-shaped cathode element enclosing a filament **22*a*, although the cathode may simply be a separate, non-enclosed filament capable of emitting electrons when thermally activated, and is preferably supported from the control grid substrate 29. It will be understood that the cathode, or cathode-forming filament, could be independently supported directly from the support rods 21 if desired. If a honeycomb-shaped cathode enclosing a filament is employed, the cathode is preferably of the general construction disclosed in my earlier above-identified patents, formed of a pair of sheet members such as two nickel sheet members 28*a*, 28*b*, for example having a thickness of about 0.010 inch, each shaped to define an outwardly projecting, truncated V-shaped or channel shaped ridge extending the height of the cathode and having outwardly convergent similarly inclined sides and a flat outer wall paralleling the main or medial plane of the cathode, giving the channel of each sheet member a truncated V-shaped or truncated isosceles triangular configuration in transverse cross section. The sheet members are assembled together, as by spot welding at the corners thereof, to form a rigid and stable cathode structure with the V-shaped ridges projecting in opposite directions to collectively define a tunnel formation 22*b* of hexagonal or honeycomb configuration in which the filament winding is disposed. The filament winding or windings 22*a*** are preferably formed of spiral tungsten coils coated by an insulating layer of high temperature ceramic or other suitable coating material, and preferably disposed with dual interlocking coil filaments wound in such a manner that one of the filament coils has clockwise turns and the other has counterclockwise turns to present maximum heat at the center area of the cathode and simultaneously cancel AC frequencies. The honeycomb design of the ridge formation produced by the truncated V-shaped channel sections provides maximum resistance to heat warpage from heating the cathode to operating temperature, assuring that the flat surface of the hexagonal or honeycomb-shaped tunnel nearest and facing the control grid, which surface is coated with electron emission cathode material, will remain flat and parallel to the control grid.

The control grid 23, when viewed in front elevation from the faceplate of the tube, has a generally circular configuration or profile, in the illustrated embodiment, although it will be appreciated that the designer is free to choose whatever shape he may desire for the perimeter or profile of the control grid. The illustrated control grid 23 comprises a ceramic substrate panel 29 having a circular profile, and preferably having a thickness adjacent its perimeter of about 3 millimeters, so as to provide a structure of dimensions which can be readily handled by commercial manufacturers, while the central portion of the substrate is provided with a truncated V-shaped well or trough 30 having inclined, forwardly converging side walls and top and bottom walls dimensioned to receive the major portion of the confronting half of the hexagonally spaced tunnel formation **22*b* of the cathode therein but with the flat electron emission face 22*c* of the cathode tunnel formation 22*b* spaced slightly out of physical engagement with the confronting portion of the base wall of the well 30 in the ceramic substrate 29. The ceramic substrate 29 in the illustrated single beam embodiment is provided with a metal layer 31 which may, for example, be of nickel, silver, platinum, gold, rhodium, iridium, chromium or ruthenium. The metal layer has a carefully formed and shaped beam-controlling aperture 31*a* formed therein as hereinafter described, and may be processed by known photoetching procedures to etch away unwanted or unneeded portions of the metal layer whereby the remaining metal layer portions form conductor paths leading from those metal layer portions surrounding the beam aperture 31*a* to the perimeter to communicate with feedthrough connection terminals for connection to the base pins of the cathode ray tube. The substrate 29 is provided, prior to depositing the metal layer 31 thereon, with a preformed beam aperture (or apertures) 29*a*, as later described, to register with the metal layer aperture 31*a*, the preformed substrate aperture 29*a* preferably being slightly larger than the metal layer aperture 31*a* to be formed. The substrate 29 and metallic layer portions 31 of the control grid are preferably shielded by a metal shielding sleeve or tubing 23*a* secured to the periphery of the substrate to reduce outside interference from electrical or magnetic sources, and the control grid is supported directly from the support rods 21 by appropriately positioned radial support wires 27**.

It will be appreciated that the substrate panel 29 of the control grid 23 need not necessarily have the well 30, disclosed in my said earlier patents, for receiving a major portion of the confronting cathode tunnel formation nested therein, but may be simply a flat substrate panel with parallel front and back faces formed of ceramic or similar appropriate substrate material having a thickness which is suitably chosen to permit the metallic layer thereon, whether formed on the rear face confronting the cathode or filament, or on the front face confronting the faceplate, to be spaced appropriate distances from the cathode or filament and the first anode 24.

The first anode 24, sometimes referred to as an accelerating grid or element G-2, is similar in construction to the control grid 23 in that it employs a substrate 32 of ceramic or other suitable material which may be of the identical size and design as the control grid substrate and is likewise provided with an aperture 32*a* for each beam to be controlled. If the substrate 29 for the control grid is of the type provided with the well 30 therein, economy of manufacture can be achieved by using the same substrate configuration for the first anode substrate 32, although such a well is unnecessary for the first anode substrate, and the substrate can merely be disposed with the well facing towards the faceplate of the cathode ray tube, thus providing a flat planiform substrate surface facing toward the cathode and provided with a layer 33 of the metallic material thereon like the metallic layer material on the control grid, photoetched if desired to provide conductor lead patterns as for the control grid. A shield 24*a*, like shield 23*a* of the control grid, surrounds the first anode substrate in the illustrated embodiment.

Immediately forwardly, or toward the faceplate, from the first anode 24 is the focus anode 25, which in the illustrated embodiment, comprises a forward larger diameter cylindrical tube section 34 curving rearwardly inwardly to join a smaller diameter tube portion 35 having a carefully sized rear focus aperture at the end thereof nearest the cathode, and the accelerating anode 26 similarly may employ a cylindrical larger diameter forward tube section 36 and a smaller diameter rearward tube section 37 with a carefully sized and shaped aperture in the vertical wall portion at the juncture of the forward and rearward tube sections for passage of the electron beam therethrough and a shield 37*a* outwardly surrounding the tube portion 37. The focus anode 25 and accelerating anode 26 may be constructed generally in accordance with the teachings of my said earlier U.S. patents relating to the focus anode and accelerating anode assembly modified to provide for focusing and acceleration of only a single beam, rather than a plurality of beams, in the single beam electron gun example herein described.

Figure 5:
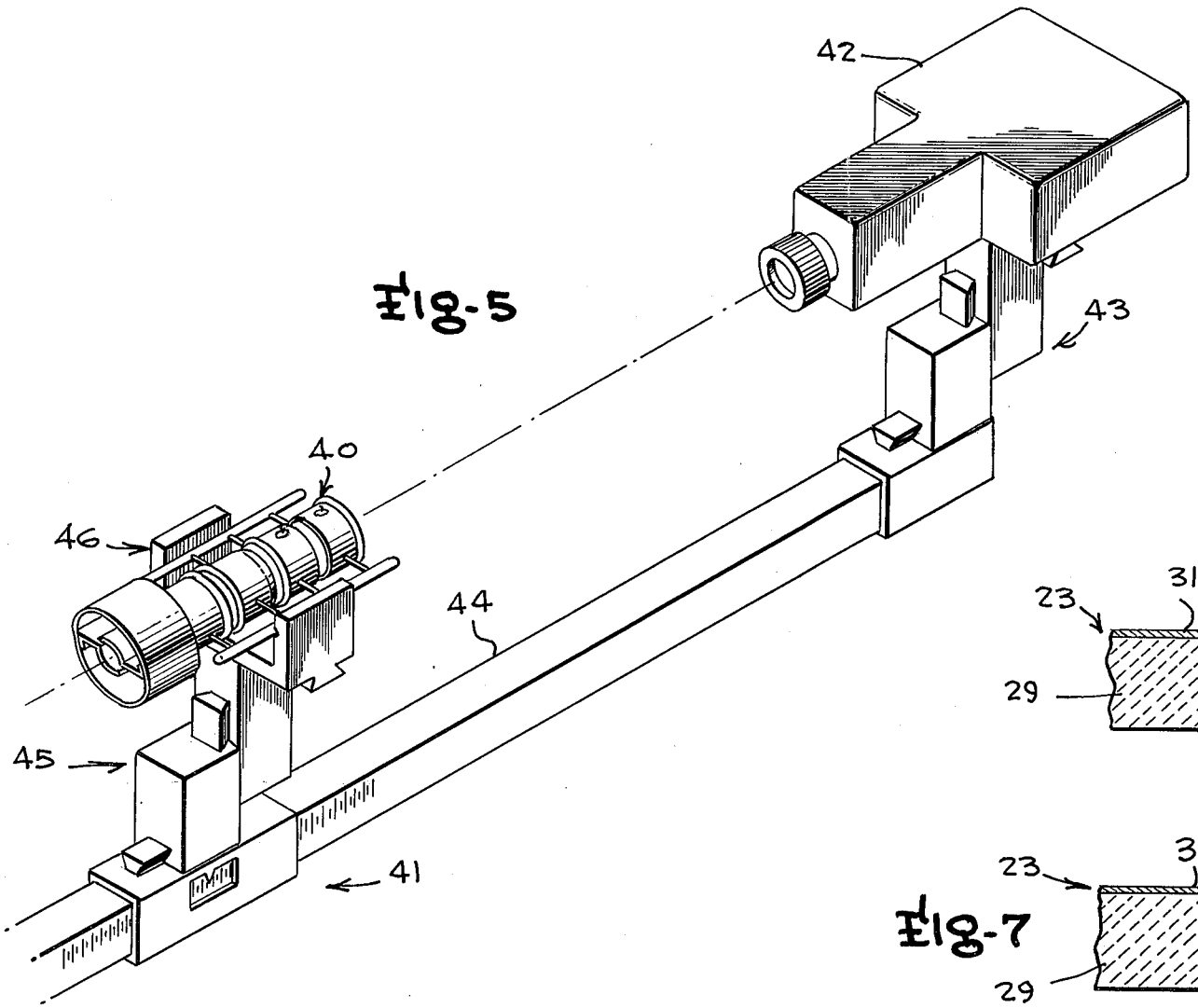
FIG. 5 is a somewhat diagrammatic view of the laser bench assembly and skeleton electron gun mounted thereon before installation of the cathode, to precisely form the beam forming apertures in the metal layers of the control grid and first anode by a laser beam in accordance with the present invention.
Figure 6:
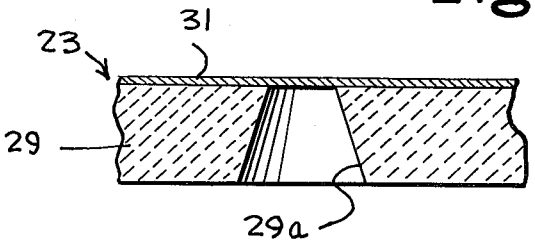
FIG. 6 is an enlarged section view of the control grid portion of the electron gun showing its condition just prior to forming of the aperture in the metal layer thereon.

The method of the present invention for forming the electron gun contemplates the mounting of an electron gun skeleton subassembly, indicated generally by the reference character 40 in FIG. 5, on a laser bench assembly 41, generally resembling an "optical bench" but employing a laser beam source rather than the visible light source used in an optical bench. The laser bench may be broadly described as including a laser beam source 42 located, for example, near one end of a supporting rail 44 on a laser mount 43, and an adjustable mounting stage 45 and electron gun clamping device 46 for the electron gun skeleton subassembly 40 is movably supported for lengthwise movement on the supporting rail 44 by any suitable mounting stage structure such as a sliding clamp-type bracket or sleeve formation slidable on the rail. Either the adjustable mounting stage 45, or the mount 43 for the laser beam source, is adjustable, or preferably both are adjustable, along a vertical adjustment axis, and along two horizontal adjustment axes, parallel and perpendicular to the rail axis, thus providing three-dimensional adjustment of the stage 45 and mount 43. The structure for accomplishing these adjustments may take the form, for example, of vernier adjustment mechanisms or lag screw controlled dovetail slide devices, incorporated in the mounting stage 45 and/or the laser beam mount 43 so that the laser beam can be caused to precisely move relative to the skeleton subassembly 40 in any direction transverse to the laser beam axis. Normally, the laser beam axis will substantially parallel the longitudinal axis of the rail 44. The skeleton subassembly 40 to be supported by the adjustable mounting stage 45 in carrying out the method of the present invention for precisely forming the metal layer apertures for the control grid 23 and first anode 24 will comprise the control grid and first anode assembled by their associated metal shielding sleeves and support wires 27 to the glass rods 21 forming the electron gun's supporting frame, along with the focus anode 25 and an electrode anode assembly 26 similarly supported on the glass rod framework 21. The cathode 22 will not, however, have been mounted on the electron gun assembly at this stage.

Before assembly of the substrates 29 and 32 for the control grid 23 and first anode 24 in the skeleton subassembly 40, the substrates are processed to provide the beam apertures through the substrate material, and to provide the metal layers 31 and 33, respectively, thereon. The metal layers 31 and 33 may be applied by known deposition processes such as described in my earlier above-identified patents, to provide an uninterrupted precisely uniform and flat layer 31 or 33 of appropriate thickness covering the appropriate flat face of the substrates and without any apertures therein. The substrate material should be a material which will not warp upon exposure to temperatures in the range of from 700° to about 800° F under high vacuum conditions, and preferably is a material such as alumina or soapstone which can be shaped, for example, by stamping or by shaping in a die, or by grinding, to provide the appropriate profile and may be drilled or otherwise worked to provide a slightly oversized aperture or apertures 29*a*, 32*a* in any desired shape at the location where the metal layer apertures 31*a*, 33*a*, are to occur. The substrate is formed so as to have a precisely flat face for receiving the metal layer deposited or "plated" on the flat substrate face in such a way that the metal and the substrate are firmly bound together in a highly reliable way, such as by a vacuum process known as sputtering (including "dry" sputtering) or other well-known methods of deposition of metallic layer material onto suitable substrates, as described in my said earlier patents, taking care that the flatness of the "coated" substrate is not adversely affected by temperatures in the 700°–800° F range and the high vacuum (i.e., very low subatmospheric pressure levels) encountered in the layer forming process.

Figure 7:
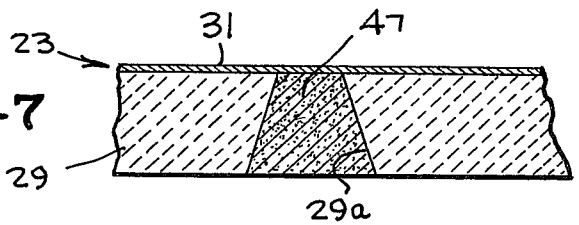
FIG. 7 is a section view similar to FIG. 6 showing the substrate for the control grid with the preformed aperture in the substrate occupied by temporary filler material and the metal layer deposited thereon, before they are processed to form the beam control apertures therein on the laser beam assembly.

In order to insure that the metal layers 31 and 33 be precisely flat, even over the area where the oversized substrate apertures 29*a*, 32*a* occur, these preformed apertures are temporarily filled before application of the metal layer onto the substrate with a filler substance as indicated at 47 in FIG. 7, which is suitable for temporary use but which may be chemically, mechanically or thermally removed after the metal layer has been formed on the flat substrate face. For example, the filler material 47 may be water-soluble salts such as sodium acetate, potassium bromide, magnesium sulfate, etc., organic materials which are solids or gels at ambient temperatures and which dissolve in suitable solvents, melt or vaporize readily (e.g., paraffin wax, beeswax, carbowax, gelatin, agar, etc.), or relatively insoluble inorganic compounds such as calcium carbonate. Suitable binders or solvents may be used in effecting deposition of the filler material and appropriate solvents or chemical agents may be used for removal. Care is taken that the body of filler material 47 in the preformed substrate apertures 29*a*, 32*a* provides a surface which is sufficiently flat, smooth and flush with the flat face of the substrate on which the metal layer is to be deposited. The layer of the metallic material, such as metal layer 31 or 33, can thus be precisely formed to the desired thickness, for example, a thickness of about 0.0001 inch up to 0.0005 or any desired thickness, after which the temporary filling material is removed, by appropriate chemical, mechanical or thermal means leaving a continuous metal layer 31 or 33 of even uniform thickness spanning the oversized substrate aperture 29*a*, 32*a* and coating the remainder of the flat face of the substrate. The coated substrate 29 designed to form a control grid 23 may also be photo-etched, if desired, to remove any unwanted portions of the metal layer and leave merely a continuous small metal layer portion spanning the preformed substrate aperture and extending outwardly for a desired small distance therefrom and an associated metal layer conductive path extending from the aperture-covering portion to the perimeter for connection to the leadout conductor coupled to the base pins of the cathode ray tube. The metal coated substrates 29 and 32, without apertures formed in their metal layers, formed in this manner, and after removal of the temporary filler material, are then mounted in the skeleton subassembly 40 by attachment in the usual manner to their associated support wires 27, with the shields mounted on the perimeters of the substrates, and this skeleton subassembly 40 is then assembled on the mounting stage 45 of the laser bench assembly 41 for forming the beam-controlling apertures in the portions of the metal layers of the control grid and first anode covering the substrate apertures.

The electron gun skeleton subassembly 40 prepared as previously described is mounted in the upper clamp portion 46 of the tri-directionally adjustable mounting stage 45 and the adjustable mechanism for stage 45 or the adjustable stage mechanism for the laser mount 43, or both, is adjusted to locate the centers of the preformed substrate apertures 29*a*, 32*a* in precise alignment with the axis of the laser beam to be projected from the laser light source 42. By adjusting the focusing of the laser beam, correctly selecting the distance between the laser beam source and the skeleton subassembly 40 for the electron gun, and adjusting the position of the gun skeleton in its mount, one can precisely determine the size of the apertures to be formed in the metal layer covering the preformed substrate openings to provide exactly the right aperture size of the electron beam apertures in the metal layers on the substrates and insure perfect alignment of the apertures in the control grid and first anode, both with great precision. It will be appreciated that the laser beam projected by the laser source 42 will pass through the preformed substrate apertures 29*a*, 32*a* and introduce the desired apertures in the metal layers on these substrates struck by the laser beam, and will pass also through the apertures and tubes in the focus anode and accelerating anode assembly. Also, this procedure for forming the electron beam-controlling apertures of the control grid and first anode is highly flexible and adaptable to production of beam-control apertures of non-round shape, such as beam apertures which are substantially rectangular or oval in shape with their major axes extending vertically or inclined at any desired angle, simply by relative movement of the skeleton subassembly 40 with respect to the laser beam, in any desired direction transverse to the beam axis, as by adjustment of the skeleton assembly mounting stage 45 or the laser mount 43, while the laser beam continues to be focused on the metal layer material so that the apertures in the control grid and first anode will have a configuration and orientation corresponding to the relative movements of the laser beam and skeleton subassembly. It will be evident that the skeleton subassembly 40 may be positioned in clamp portion 46 with either the control grid 23 or the accelerating anode 26 facing the laser light source 42. Also, the temporary introduction of a laser-impenetrable material between the control grid 23 and first anode 24 would permit forming apertures of different shapes in the metal layers such as, for example, a round aperture in control grid 23 and a substantially rectangular aperture in first anode 24. Such a laser bench arrangement or jig for introducing electron beam apertures in the electron gun skeleton subassembly is also highly suitable to mass-production procedures involving use of automatic computer-type control devices, by providing motorized drives for the mounting stage portions defining the different axes of adjustment and controlling the motorized drives from appropriate computer-controlled output signals. Both the manually adjusted laser bench arrangement and the automatically controlled bench arrangement insure the achievement of exactly correct alignment and shaping of the apertures in the metal layers of the control grid and first anode because of the optical alignment characteristics of the laser beam, and the dimensions of the apertures formed in these components by the laser beam while the components are maintained in precisely correct relationship to each other.

After the electron beam-controlling apertures are thus formed by the laser beam in the metal layers on the control grid and first anode of the electron gun skeleton subassembly 40, the skeleton subassembly is then removed from the electron gun clamping device 46 and the honeycomb-type cathode 22, or the cathode-forming filament if the honeycomb cathode is not used, are welded or fastened in any suitable manner to the control grid to complete the assembly of the electron gun.

The electron gun may then be mounted in the neck portion of the cathode ray tube glass envelope, with suitable electrical connections being made between the base pins of the cathode ray tube and the leadout connectors of the electron gun components, the faceplate section 18 may then be fused to the funnel portion 17 of the glass envelope and the interior of the cathode ray tube evacuated in the usual manner, and if desired traces of argon or other desired inert gas, or a combination of traces of inert gases, may be added and the glass envelope of the tube appropriately sealed.

I claim:

1. The method of processing elements of an electron gun assembly for cathode ray tubes and the like to provide precision-shaped, sized, and aligned beam-control apertures in elements thereof, the electron gun assembly in completed form including a cathode, control grid, first anode, focus anode, and accelerating anode elements rigidly assembled in predetermined alignment along a longitudinal reference axis paralleling the axis of one or more electron beams to be generated, shaped, controlled, focused and accelerated thereby and the control grid and first anode elements each comprising a substrate having a substrate aperture therethrough for each electron beam to be formed and including a flat face substantially perpendicular to the beam axis covered with a thin layer of metal overlying at least the portions of said flat face immediately adjacent each said substrate aperture and having a beam-controlling aperture through said layer at each said substrate aperture, comprising the steps of:

a. preforming the substrate aperture in substrates shaped to form said control grid and first anode as oversized apertures relative to the beam-control apertures to be formed in their associated metal layers,
b. forming the metal layers on said substrates as flat metal layers of uniform thickness extending over predetermined areas of a flat face portion of each substrate and uninterruptedly spanning the preformed substrate apertures without any beam-control apertures therein,
c. assembling such substrates of step (b) for a control grid and first anode on a supporting frame member of the electron gun assembly together with focus anode and accelerating anode elements and without any cathode element assembled therewith to form a skeleton subassembly,
d. mounting the electron gun skeleton subassembly of step (c) on a laser bench assembly having a laser beam source and means for adjusting the position of the electron gun skeleton subassembly with respect to the laser beam two-dimensionally in a plane perpendicular to the laser beam axis and lengthwise along the bench assembly,
e. focusing the laser beam in the metal layer zones spanning the substrate apertures of the control grid and first anode substrates of said skeleton subassembly and directing the laser beam along a predetermined axis to strike such metal layer zones and concurrently form beam-control apertures of desired size, shape and alignment in said layer zones, and
f. assembling the cathode thereon to form the completed electron gun assembly.

2. The method defined in claim 1, wherein step (b) includes the steps of filling said preformed substrate apertures prior to forming said metal layers thereon with a temporary filler material providing a flat surface of filler material spanning the substrate apertures and flush with said flat face portions, forming the metal layers to extend over and cover said flat surface of filler material to said uniform thickness, and removing the temporary filler material from said substrate apertures.

3. The method defined in claim 1, including the step of producing relative movement between said electron gun skeleton subassembly and the laser beam in one or more directions perpendicular to the axis of the laser beam while the laser beam is operated to strike the metal layers on said substrates to form properly aligned beam-control apertures of predetermined shape in the metal layer portions spanning the substrate apertures of the control grid and first anode substrates.

4. The method defined in claim 2, including the step of producing relative movement between said electron gun skeleton subassembly and the laser beam in one or more directions perpendicular to the axis of the laser beam while the laser beam is operated to strike the metal layers on said substrates to form properly aligned beam-control apertures of predetermined shape in the metal layer portions spanning the substrate apertures of the control grid and first anode substrates.

5. The method defined in claim 1, including the step of moving said electron gun skeleton subassembly along a rectilinear path inclined upwardly and laterally relative to a vertical axis perpendicular to and passing through the axis of the laser beam while the laser beam is operated to strike the metal layers on said substrates to form properly aligned beam-control apertures of coordinated oblong shape in the metal layer portions spanning the substrate apertures of the control grid and first anode substrates for shaping electron beams passing therethrough to a like oblong cross-sectional configuration having their major transverse axes inclined at an angle to both the vertical and horizontal.

6. The method defined in claim 2, including the step of moving said electron gun skeleton subassembly along a rectilinear path inclined upwardly and laterally relative to a vertical axis perpendicular to and passing through the axis of the laser beam while the laser beam is operated to strike the metal layers on said substrates to form properly aligned beam-control apertures of coordinated oblong shape in the metal layer portions spanning the substrate apertures of the control grid and first anode substrate for shaping electron beams passing therethrough to a like oblong cross-sectional configuration having their major transverse axes inclined at an angle to both the vertical and horizontal.

7. The method defined in claim 1, wherein the electron gun skeleton subassembly is located relative to the laser beam source in performing steps (d) and (e) to dispose said laser beam source adjacent the control grid end of said skeleton subassembly whereby the laser beam simulates in size and axial location the electron beam to be generated and shaped by the completed electron gun and progresses from the region of the electron gun skeleton subassembly to be occupied by the cathode to the accelerating anode end thereof.

8. The method defined in claim 2, wherein the electron gun skeleton subassembly is located relative to the laser beam source in performing steps (d) and (e) to dispose said laser beam source adjacent the control grid end of said skeleton subassembly whereby the laser beam simulates in size and axial location the electron beam to be generated and shaped by the completed electron gun and progresses from the region of the electron gun skeleton subassembly to be occupied by the cathode to the accelerating anode end thereof.

9. The method defined in claim 1, wherein the substrates are alumina or soapstone.

10. The method defined in claim 1, wherein said temporary filler material is chemically, mechanically or thermally removed from said substrate apertures following forming of the metal layers on said substrates and before mounting the skeleton subassembly on the laser bench assembly.

11. The method defined in claim 9, wherein the metal layers on the substrates are formed of a metal chosen from the group consisting of nickel, silver, platinum, gold, rhodium, iridium, chromium and ruthenium.

12. The method of processing elements of an electron gun assembly for electron beam tubes such as cathode ray tubes and similar devices to provide precision-shaped, sized, and aligned beam-control apertures in elements thereof, the electron gun assembly in completed form including at least a cathode, control grid and first anode rigidly assembled in predetermined alignment along a longitudinal reference axis paralleling the axis of one or more electron beams to be generated, shaped, controlled, focused and accelerated thereby and the control grid and first anode elements each comprising a substrate having a substrate aperture therethrough for each electron beam to be formed and including a flat face substantially perpendicular to the beam axis covered with a thin layer of metal overlying at least the portions of said flat face immediately adjacent each said substrate aperture and having a beam-controlling aperture through said layer at each said substrate aperture, comprising the steps of:

a. preforming the substrate apertures in substrates shaped to form said control grid and first anode as oversized apertures relative to the beam-control apertures to be formed in their associated metal layers,
b. forming the metal layers on said substrates as flat metal layers of uniform thickness extending over predetermined areas of a flat face portion of each substrate and uninterruptedly spanning the preformed substrate apertures without any beam-control apertures therein,
c. assembling such substrates of step (b) for a control grid and first anode on a supporting frame member of the electron gun assembly without any cathode element assembled therewith to form a skeleton subassembly,
d. mounting the electron gun skeleton subassembly of step (c) on a laser bench assembly having a laser beam source and means for adjusting the position of the electron gun skeleton subassembly with respect to the laser beam two-dimensionally in a plane perpendicular to the laser beam axis and lengthwise along the bench assembly,
e. focusing the laser beam in the metal layer zones spanning the substrate apertures of the control grid and first anode substrates of said skeleton subassembly and directing the laser beam along a predetermined axis to strike such metal layer zones and concurrently form beam-control apertures of desired size, shape and alignment in said layer zones, and
f. assembling the cathode thereon to form the completed electron gun assembly.

13. The method defined in claim 12, wherein step (b) includes the steps of filling said preformed substrate apertures prior to forming said metal layers thereon with a temporary filler material providing a flat surface of filler material spanning the substrate apertures and flush with said flat face portions, forming the metal layers to extend over and cover said flat surface of filler material to said uniform thickness, and removing the temporary filler material from said substrate apertures.

14. The method defined in claim 12, including the step of producing relative movement between said electron gun skeleton subassembly and the laser beam in one or more directions perpendicular to the axis of the laser beam while the laser beam is operated to strike the metal layers on said substrates to form properly aligned beam-control apertures of predetermined shape in the metal layer portions spanning the substrate apertures of the control grid and first anode substrates.

15. The method defined in claim 13, including the step of producing relative movement between said electron gun skeleton subassembly and the laser beam in one or more directions perpendicular to the axis of the laser beam while the laser beam is operated to strike the metal layers on said substrates to form properly aligned beam-control apertures of predetermined shape in the metal layer portions spanning the substrate apertures of the control grid and first anode substrates.

16. The method defined in claim 12, including the step of moving said electron gun skeleton subassembly along a rectilinear path inclined upwardly and laterally relative to a vertical axis perpendicular to and passing through the axis of the laser beam while the laser beam is operated to strike the metal layers on said substrates to form properly aligned beam-control apertures of coordinated oblong shape in the metal layer portions spanning the substrate apertures of the control grid and first anode substrates for shaping electron beams passing therethrough to a like oblong cross-sectional configuration having their major transverse axes inclined at an angle to both the vertical and horizontal.

17. The method defined in claim 13, including the step of moving said electron gun skeleton subassembly along a rectilinear path inclined upwardly and laterally relative to a vertical axis perpendicular to and passing through the axis of the laser beam while the laser beam is operated to strike the metal layers on said substrates to form properly aligned beam-control apertures of coordinated oblong shape in the metal layer portions spanning the substrate apertures of the control grid and first anode substrate for shaping electron beams passing therethrough to a like oblong cross-sectional configuration having their major transverse axes inclined at an angle to both the vertical and horizontal.

18. The method defined in claim 12, wherein the electron gun skeleton subassembly is located relative to the laser beam source in performing steps (d) and (e) to dispose said laser beam source adjacent the control grid end of said skeleton subassembly whereby the laser beam simulates in size and axial location the electron beam to be generated and shaped by the completed electron gun and progresses from the region of the electron gun skeleton subassembly to be occupied by the cathode to the accelerating anode end thereof.

19. The method defined in claim 13, wherein the electron gun skeleton subassembly is located relative to the laser beam source in performing steps (d) and (e) to dispose said laser beam source adjacent the control grid end of said skeleton subassembly whereby the laser beam simulates in size and axial location the electron beam to be generated and shaped by the completed electron gun and progresses from the region of the electron gun skeleton subassembly to be occupied by the cathode to the accelerating anode end thereof.

20. The method defined in claim 12, wherein said temporary filler material is chemically, mechanically or thermally removed from said substrate apertures following forming of the metal layers on said substrates and before mounting the skeleton subassembly on the laser bench assembly.

* * * * *